United States Patent [19]

Abel

[11] 4,382,641

[45] May 10, 1983

[54] SEWING MACHINE STORAGE CABINET

[75] Inventor: Donald Abel, Morton, Ill.

[73] Assignee: Morton Glass Works, Morton, Ill.

[21] Appl. No.: 185,976

[22] Filed: Sep. 10, 1980

[51] Int. Cl.[3] ..... A47B 29/00; A47B 77/10

[52] U.S. Cl. ..... 312/21; 312/26; 312/30; 312/302; 312/313; 112/217.1

[58] Field of Search ..... 312/21, 23, 26, 27, 312/30, 29, 20, 276, 313, 314, 290; 108/47, 48, 38, 90, 123; 112/217.1

[56] References Cited

U.S. PATENT DOCUMENTS

| | | | |
|---|---|---|---|
| 29,493 | 8/1860 | Iske | 312/302 |
| 110,507 | 12/1870 | Smith | 312/208 |
| 667,164 | 1/1901 | Carder | 108/48 |
| 1,077,515 | 11/1913 | Fanning | 312/233 |
| 1,612,132 | 12/1926 | Lannom | 312/313 |
| 1,768,413 | 6/1930 | Lyth | 312/313 |
| 1,795,636 | 3/1931 | Chandler | 108/90 |
| 1,849,446 | 3/1932 | Bartlett . | |
| 1,858,765 | 5/1932 | Cramer | 312/313 |
| 2,156,759 | 5/1939 | Hume et al. | 312/27 |
| 2,200,919 | 5/1940 | Fritch | 312/302 |
| 2,778,705 | 1/1957 | Barker | 312/313 |
| 2,817,571 | 12/1957 | Lee | 312/313 |
| 2,958,304 | 11/1960 | Arbib | 112/217.1 |
| 2,987,355 | 6/1961 | Sandefur | 312/23 |
| 3,062,605 | 11/1962 | Cannon | 108/38 |
| 3,297,387 | 1/1967 | Parsons | 312/290 |
| 3,745,936 | 7/1973 | Bennett | 108/48 |
| 3,748,010 | 7/1973 | Garte | 312/314 |
| 4,100,858 | 7/1978 | Bue et al. | 108/48 |
| 4,103,633 | 8/1978 | Frank et al. | 312/29 |
| 4,136,622 | 1/1979 | Bue et al. | 312/314 |
| 4,155,609 | 5/1979 | Skafte et al. | 312/314 |
| 4,285,556 | 8/1981 | Loeffel | 312/290 |

FOREIGN PATENT DOCUMENTS

| | | | |
|---|---|---|---|
| 1540576 | 2/1979 | United Kingdom | 108/48 |

*Primary Examiner*—Victor N. Sakran
*Attorney, Agent, or Firm*—Bacon & Thomas

[57] ABSTRACT

A sewing machine storage cabinet is disclosed wherein a first portion is attached to a wall and contains a sewing machine attached to a table capable of moving from a vertical folded position, about a horizontal axis, to a horizontal operative position. A second part of the cabinet is attached to the first part and provides a door to cover the table and associated machine when in its folded position. The exterior of the door may be provided with a design to improve its aesthetic quality when in its closed position. The cabinet also contains a sewing basket in which extra needles, thread, bobbins, etc. may be stored.

17 Claims, 7 Drawing Figures

SEWING MACHINE STORAGE CABINET

FIELD OF THE INVENTION

The present invention relates to sewing machine storage cabinets, more particularly those cabinets attached to a wall.

BRIEF DESCRIPTION OF THE PRIOR ART

Sewing machines have been well known for many many years and have been in use in virtually every household in the United States since the turn of the century. Since sewing machines usually require a flat surrounding work area in which to position the cloth and associated sewing accessories, they must usually be moved from a storage position into a working position in order to use them. Despite many recent advances in engineering and the use of lighter weight materials, the sewing machine of today remains cumbersome and unwieldly and the difficulty in transporting the sewing machine from its operative position to a storage area and vice versa remains a substantial problem for the average household user.

Many attempts have been made over the years to provide a sewing machine storage device, that also provides the requisite work area to eliminate the physical lifting of the machine. These were usually in the form of a floor supported cabinet or similar structure. The cabinets usually resemble a desk or similar item of furniture when the sewing machine is in its storage position and, when it is desired to utilize the sewing machine, the top is usually folded outwardly to one side and the sewing machine raised to its operative position. These cabinets, while alleviating the problem of physically lifting the sewing machine and transporting it to and from a storage area, have not totally solved the problem. They still require large amounts of floor space to use the machine, since the top of the cabinet is usually folded out beyond the perimeter of the cabinet itself. Also, since the sewing machine is stored in the cabinet, it still must be physically lifted upward to place it in its operative position.

The average household user does not utilize their sewing machine every day and, hence, sewing machines typically have a rather long useful life span. Over the years, the user's tastes in furnishings may change and, if this is the case, he/she is presented with the choice of keeping a sewing machine cabinet that may no longer fit in with the rest of the interior decor, or incurring additional expense in buying another cabinet. Also, if the machine has been in use for many years, the user may no longer be able to purchase a cabinet in which the machine will fit.

Wall attached sewing machine storage cabinets are also known, an example of which is shown in U.S. Pat. No. 3,062,605 to Cannon. While wall-mounted cabinets of this type do not require the amount of floor space as the aforementioned floor type cabinets, they still extend into the room area since they are mounted to the wall surface. Other vertically oriented storage cabinets are known, as shown in U.S. Pat. No. 4,103,633 to Frank. This cabinet is not physically attached to the wall, but is merely placed against the wall surface. Neither of these two particular examples show wall cabinets which are recessed into a wall and attached to the wall studs. The cabinet shown in the Frank et al patent eliminates the problems associated with lifting the sewing machine since it provides tracks upon which the machine is slid between its storage and operating positions. This, however, presents additional problems, since a special base must be provided for the machine in order for it to slide on the tracks of the cabinet.

Storage cabinets mounted within a wall structure and having their front surface substantially flush with the wall's surface are also well known in the art, but have typically been confined to providing storage areas for tables, ironing boards, and other light weight items.

SUMMARY OF THE INVENTION

The instant invention relates to a storage cabinet for a sewing machine wherein the storage area may be recessed into a wall such that the outermost surface of the cabinet is approximately even with the wall's surface. The cabinet according to a first embodiment of the invention comprises a first portion having a generally rectangular shape interposed between, and fastened to, adjacent wall studs. This first portion defines the storage area of the cabinet and its outermost portion extends slightly beyond the wall's surface. A second portion, comprising a frame structure having a pivotable door attached thereto is attached to the first portion.

A sewing machine support table is pivotally attached to the first portion of the cabinet near the lower end thereof such that it may pivot betwen vertical and horizontal positions about a generally horizontal axis. In its vertical position, the table is located within the cabinet to enable the external door to be closed, while in its horizontal position, the table forms a work area for the sewing machine. The sewing machine is attached to the table via a hinge or similar device which will enable the machine to lie on its side against the table when in the stored position. This minimizes the depth of the cabinet necessary to store the sewing machine.

A plurality of leaves are pivotally attached to the work table on either side of the sewing machine such that they pivot along an axis generally perpendicular of the axis of the table hinge to laterally increase the working area. These leaves, when in their unfolded position, also serve as support for the sewing machine when it is in its raised, operative position. The table, along with the leaves and sewing machine, is supported in its horizontal work position by means of support bracing connected between the table and the bottom of the first portion of the cabinet. The table support bracing comprises a pair of extendable and compressible, spring-biased members pivotally connected to the cabinet on an axis parallel to, but located below, the pivot axis of the table. Since the pivoting support point for the support struts is below the pivotal attachment of the table, the members will extend when the table is raised to its storage position. The force generated by the expansion of the coil springs will serve to reduce the force necessary to pivot the table to its stored position. Means are also provided within each member to prevent further compression when the table is in its horizontal position. This provides a solid support base for the table during the operation of the sewing machine.

Accessory storage racks are also provided within the cabinet to enable the user to store extra needles, thread, bobbins, control pedal, and the like. An upper storage rack may be movable vertically between an upper, storage position when the table is in its vertical position and a lower, usable position when the sewing machine is in its operable position. This lower portion enables the user to readily reach any of the items stored in the rack from a seated position. Another storage rack may be provided in the lowermost portion of the cabinet if desired. The position of this storage rack is such that it is below the sewing machine when it is in its stored position and, therefore, it is not necessary to movably attach this rack to the cabinet.

DETAILED DESCRIPTION OF THE PREFERRED EMBODIMENT

Figure 1:
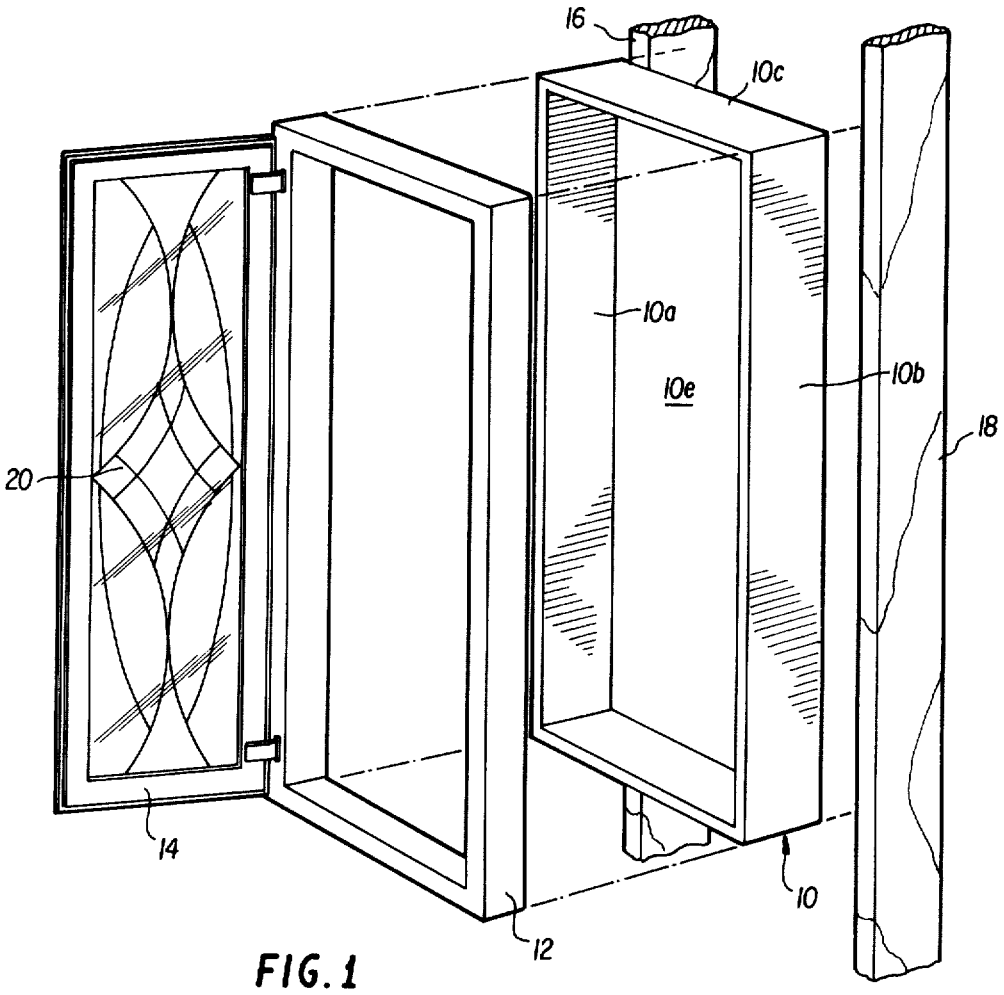
FIG. 1 is an exploded perspective view showing the cabinet structure according to the present invention.

The basic cabinet structure of the present invention is shown in FIG. 1 and comprises first cabinet portion 10 and second cabinet portion 12 having door 14 pivotally attached thereto. The first cabinet portion 10 has a generally rectangular shape and is of a width sufficient to enable it to be affixed between two standard spaced wall studs 16 and 18. First cabinet portion 10 comprises sides 10a and 10b, top and bottom 10c and 10d, and back wall 10e. Screws, nails, or other fastening devices are driven through the walls 10a and 10b into studs 16 and 18 to retain first cabinet portion 10 in position. Although the size of cabinet portion 10 may vary, it is envisioned that the size of the storage area would be approximately 14–½ inches wide, 4 inches deep and 48 inches high.

The frontmost portions of side walls 10a, 10b, and top and bottom 10c and 10d extend into the room beyond the wall's surface to enable attachment of second cabinet portion 12 thereto. The size of second cabinet portion 12 is such that it fits over the outer periphery of cabinet portion 10 and is attached thereto by screws, nails, or the like. The portion of the cabinet may be made removable from the first cabinet portion, if desired. Door 14 is pivotally attached to cabinet portion 12 and may contain a decorative panel 20 of stained glass or other materials having a pleasing aesthetic effect. Obviously, door 14 and cabinet portion 12 would be provided with a latch mechanism to retain the door in its closed position, but these have been omitted for the purposes of clarity.

Figure 2:
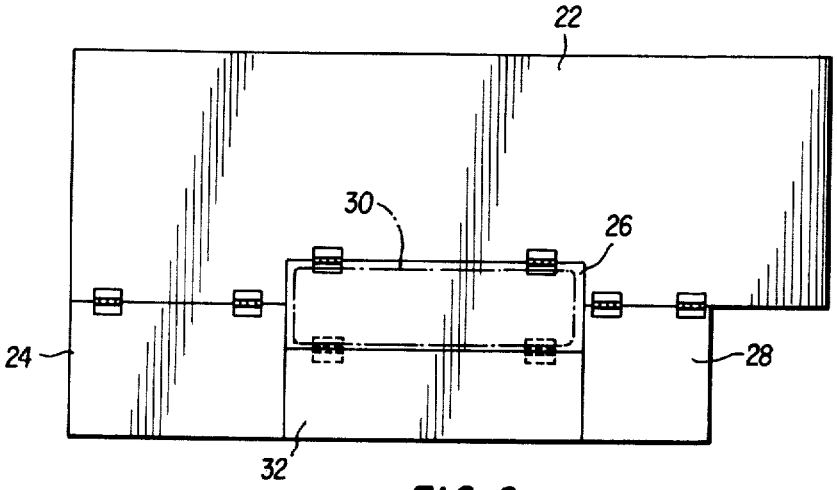
FIG. 2 is a plan view of the sewing table with the leaves unfolded according to the present invention.

A plan view of the sewing table assembly as shown in FIG. 2 and comprises sewing table 22 having leaves 24, 26 and 28 pivotally attached thereto. Leaves 24 and 28 are attached to table 22 such that they may be folded over so as to lay on top of table 22 when the assembly is in its storage position. Sewing machine 30, shown in phantom in FIG. 2, has its base rigidly attached to leaf 26, which is attached to table 22 so that it may pivot approximately 90° thereto to enable the sewing machine to lie flat on its side against table 22 when stored. Leaf 32 is pivotally attached to leaf 26 such that it lies flat against the bottom of leaf 26 when the sewing machine is in its storage position. Thus, when leaves 24 and 28 are folded against table 22, when sewing machine 30 is folded against table 22, and leaf 32 is folded against leaf 26, the table assembly may be pivoted into a vertical orientation within cabinet portion 10.

Figures 3, 4:
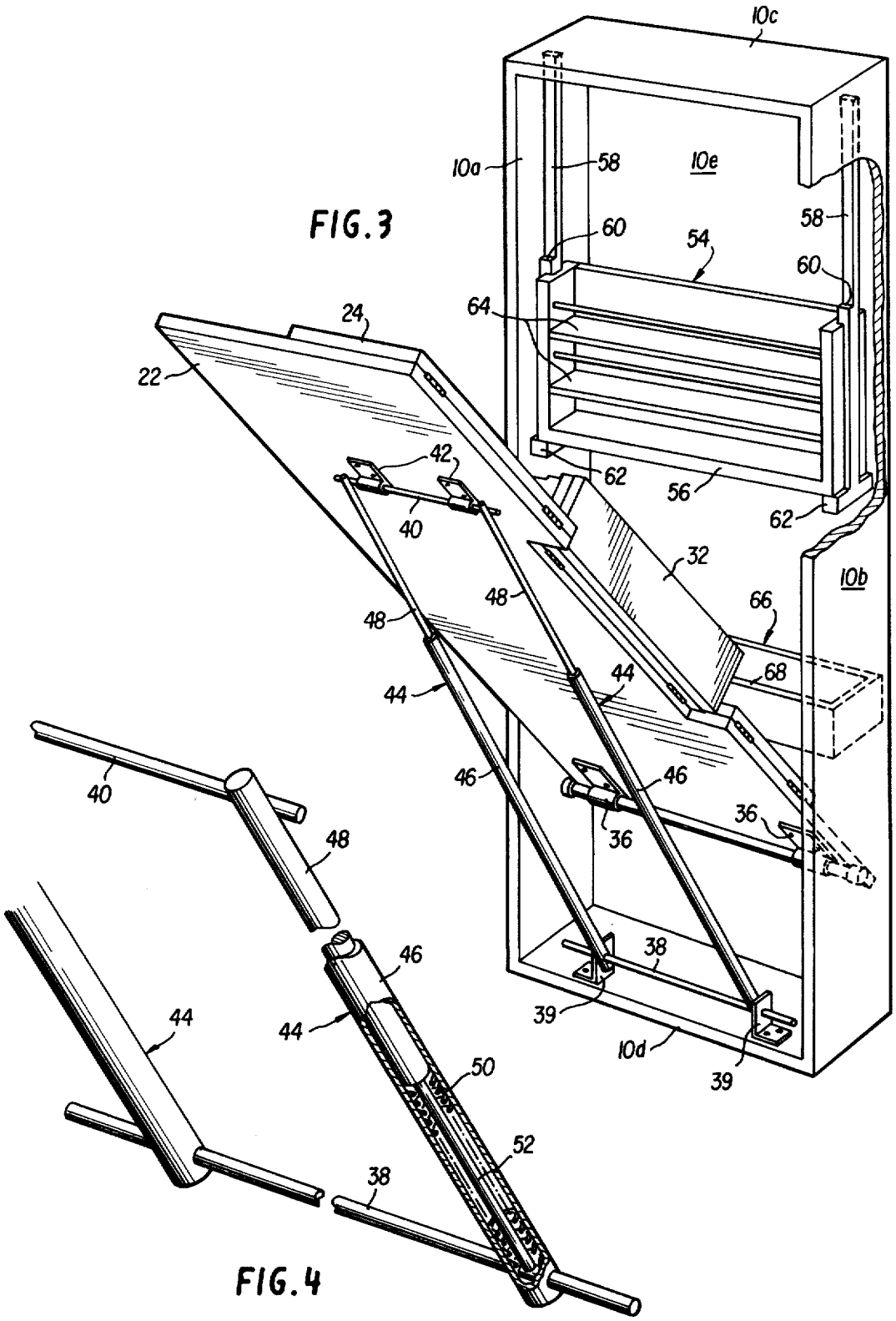
FIG. 3 is a perspective view of a sewing machine cabinet according to the present invention with the sewing table between its stored and operative positions.
FIG. 4 is a perspective view, partially cut away showing the table support bracing in detail.

Table 22 is attached to cabinet 10 by cross member 34 as shown in FIG. 3. Cross member 34 may be attached to table 22 via straps 35 or by any other known means. Cross member 34 is attached to side walls 10a and 10b of first cabinet portion 10 by any known means which will enable table 22 to pivot with respect to the cabinet structure 10 about the longitudinal axis of cross member 34. Also pivotally attached to cabinet portion 10 is support cross member 38 which is parallel to, but located below table cross member 34. Support cross member 38 is attached to cabinet portion 10 by any known means, such as brackets 39, which will enable it to rotate with respect to the surrounding cabinet structure.

Support cross member 38 is connected to member 40, pivotally attached to the bottom of table 22 via straps 42 or the like, by way of compressible support struts 44. Struts 44 each comprise outer cylinder 46 in which support rod 48 is slidably disposed. The exposed end of support rods 48 are each fixedly attached to member 40, while the opposite ends of cylinders 46 are rigidly attached to cross member 38. It is understood that the inside diameter of cylinders 46 is sized to allow rods 48 to slide with respect thereto, but are sufficiently small to prevent any significant lateral motion between rods 48 and cylinders 46. It has been found that fabricating cylinders 46 and 5/8 inch steel tubing having a wall thickness of 1/16 inch provides sufficient clearance around rods 48, which may be ½ inch steel rod. Compression coil springs 50 are disposed within cylinders 46 and bear against the interior end of rod 48 and cross member 38 as shown in the cutaway portion of FIG. 4. Extending through the center of coil springs 50 are extension rods 52 which are fixedly attached to the interior end of rods 48. The length of extension rod 52 is such that, when the table 22 is in its horizontal operative position, the distal end of extension rod 52 will bear against cross member 38 to provide a rigid support base for the table. When the table is in its vertical stored position, rods 48 extend outward from cylinders 46 their maximum distance. As the table 22 is drawn into its horizontal position, rods 48 are forced into cylinders 46 to compress coil springs 50 until table 22 is in its horizontal position. As stated previously, once this position is reached, extension rods 52 bear against cross member 38 to provide a rigid support base for table 22. Coil springs 50 exert a counterbalancing force against rods 48 to minimize the effort necessary to raise table 22 to its stored position.

To facilitate the storage of various and sundry sewing accessories, upper storage basket 54, comprising generally "U" shaped frame 56 and shelves 64, is slidably disposed on rails 58 located on either side of first cabinet portion 10 and rididdly attached to sidewalls 10a and 10b. Rails 58 each have a laterally extending ledge 60 located approximately at their mid-point and have horizontally disposed stops 62 at their lowermost ends. Frame 56 has vertical notches in either side engaging rails 58 such that the basket 54 may slide vertically along rails 58. In order to retain the basket in its upper, storage position, the basket is moved vertically to its upper limit and then displaced laterally toward the back wall 10e of cabinet portion 10. This enables the bottom surface of frame 56 to engage ledges 60 and thereby prevent the basket from sliding downward. In order to place the basket in its lower position where it is convenient to a seated user of the sewing machine, it is manually moved forward toward the front of the cabinet portion to disengage the bottom of frame 56 from ledges 60 and allow it to slide downward until it rests on stops 62. Basket 54 may have a plurality of shelves 64 to store such items as extra thread, extra needles, bobbins, etc. It is necessary to raise basket 54 to its uppermost position to avoid contact between it and the sewing machine when table 22 is raised to its vertical, storage position.

Lower storage basket 66 may be provided in the lower portion of cabinet 10 and may also comprise frame 68 with one or more shelves. This basket may also be used for storage purposes and may store the sewing machine foot control pedal when not in use. It is not necessary for this lower basket to be displaced in order to place table 22 in its storage position, since its location avoids any interference between it and sewing machine 30.

Figure 6:
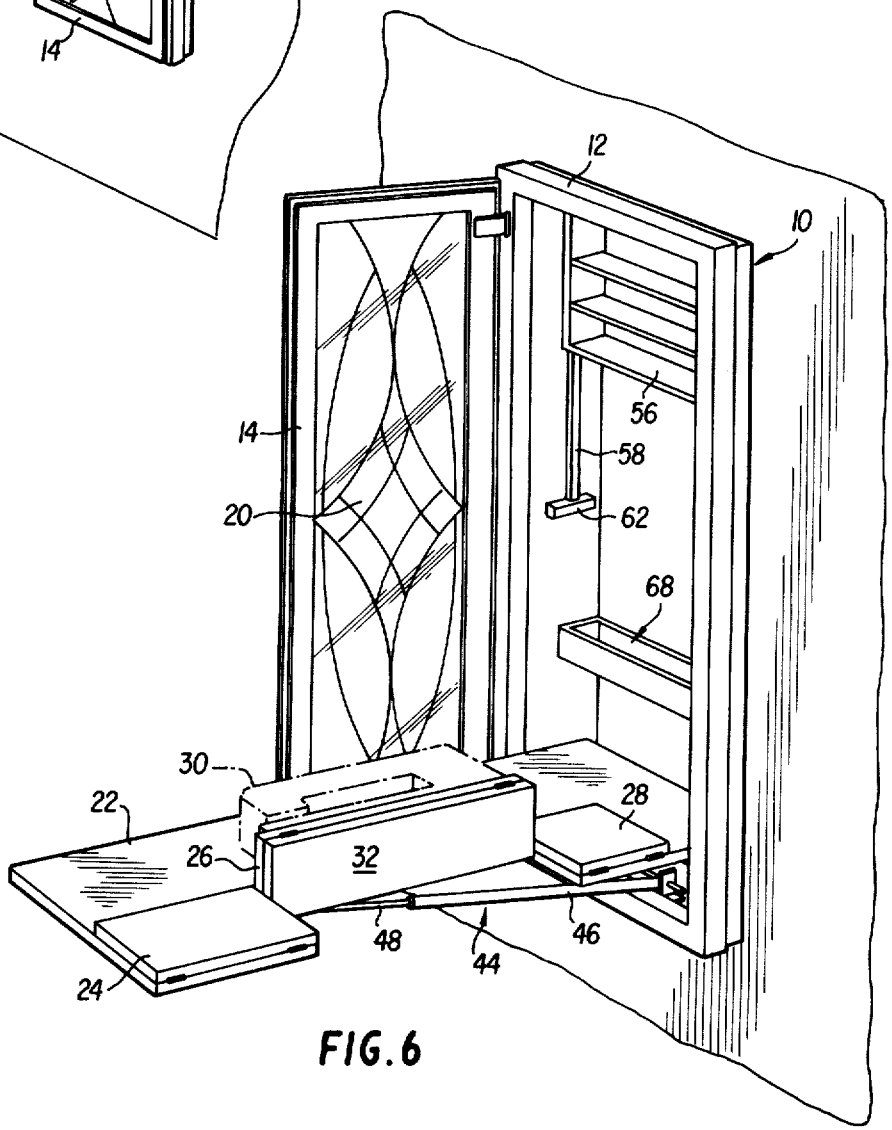
FIG. 6 is a perspective view showing the sewing table in its operative position, but with the leaves and sewing machine folded, according to the invention.
Figure 7:
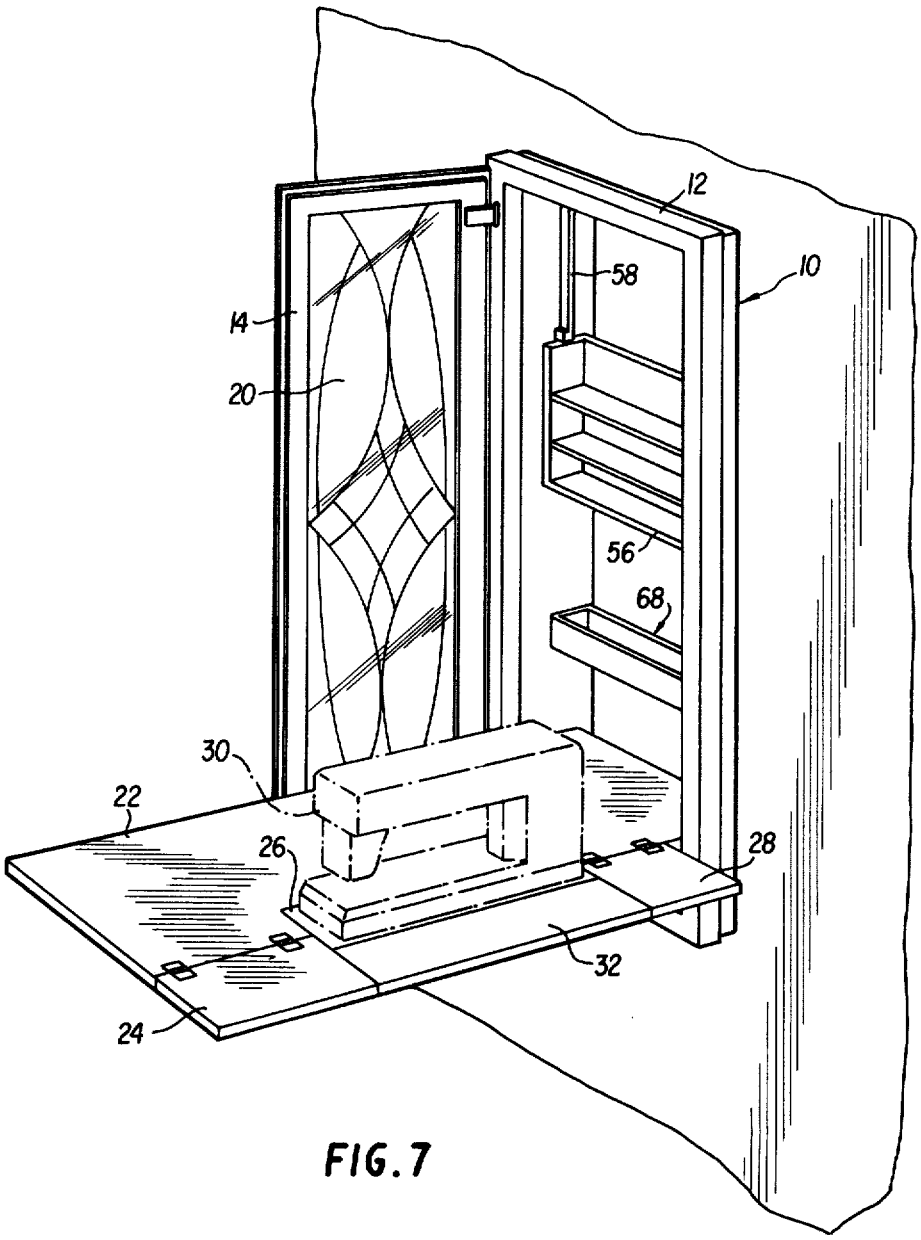
FIG. 7 is a perspective view showing the table and sewing machine in their operative positions, according to the invention.

The sewing machine 30 is shown in its ready to use position in FIG. 7. Leaves 24, 26, 28 and 32 are unfolded, extending beyond the width of cabinet portion 10, to provide sufficient working area. When it is desired to store the machine, leaves 24, 26, 28 and 32 are folded as shown in FIG. 6, upper storage basket 54 is raised, and table 22 raised to its storage position within cabinet portion 10.

Figure 5:
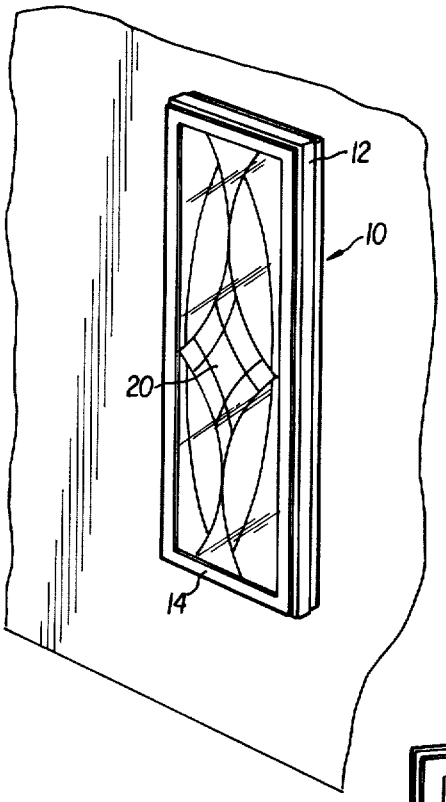
FIG. 5 is a perspective view of an alternative mounting of a sewing machine cabinet according to the invention.

It is within the scope of this invention to include minor modifications of the aforedescribed structure, such as attaching cabinet portion 10 to the surface of a wall, as shown in FIG. 5, where it is desired to add the sewing machine cabinet to an existing room. Also, door 14 may be attached directly to cabinet portion 10 without second cabinet portion 12, if desired.

The foregoing description of the preferred embodiment is not to be construed as limiting the scope of this invention, which is defined by the appended claims.

I claim:

1. A sewing machine storage cabinet comprising:

a. a cabinet portion;

b. a table having one end attached to said cabinet portion and being movable from a generally horizontal operative position to a generally vertical storage position where it is located within said cabinet by moving a distal end of the table upwardly causing the table to pivot about a generally horizontal axis and vice versa;

c. a sewing machine pivotally attached to said table such that it is pivotable with respect to said table about a generally horizontal axis between an upright, operative position and a storage position in which it lies against said table; and d. support means connected between said cabinet portion and said table to support said table when it is in its operative position, said support comprising at least one compressible and extendable member pivotally connected to said cabinet portion and to said table.

2. The sewing machine storage cabinet of claim 1 further comprising a second cabinet portion attached to said cabinet portion and having an opening through which said table extends when in its operative position; and a door pivotally attached to said second cabinet portion such that, when closed, it covers said opening.

3. The sewing machine storage cabinet of claims 1 or 2 further comprising means to attach said first cabinet portion between adjacent wall studs.

4. The sewing machine storage cabinet of claim 1 or 2 further comprising means to attach said first cabinet portion to a wall surface.

5. The sewing machine storage cabinet of claims 1 or 2 wherein said table has a plurality of foldable leaves attached thereto such that when said table is in its operative position, said leaves may be unfolded to increase the width of thetable beyond the width of said cabinet portion.

6. The sewing machine storage cabinet of claim 5 wherein said foldable leaves serves to support said sewing machine in its upright, operative position when they are unfolded.

7. The sewing machine storage cabinet of claims 1 or 2 further comprising a sewing accessory storage basket attached to said cabinet portion.

8. The sewing machine storage cabinet of claim 7 wherein said sewing accessory storage basket is movable between an operative position and a storage position.

9. The sewing machine storage cabinet of claim 7 further comprising a second accessory storage basket attached to said cabinet portion.

10. The sewing machine storage cabinet of claims 1 or 2 further comprising means attached to said support means for counterbalancing at least a portion of the weight of the sewing machine and table to reduce the force necessary to raise the table to its storage position.

11. The sewing machine storage cabinet of claim 10 wherein said means for counterbalancing comprises at least one compression coil spring.

12. The sewing machine storage cabinet of claims 1 or 2 wherein said support means is pivotally attached to said cabinet portion so as to pivot about an axis parallel to, but disposed below, said generally horizontal axis of said table.

13. The sewing machine storage cabinet of claim 12 further comprising counterbalancing means disposed within said at least one compressible and extendable member to counterbalance at least a portion of the weight of the sewing machine and table to reduce the force necessary to raise the table to its storage position.

14. The sewing machine storage cabinet of claim 13 wherein said counterbalancing means comprises a compression coil spring.

15. The sewing machine storage cabinet of claim 13 further comprising means to prevent further compression of said compressible and extendable member when said table is in its horizontal operative position so as to provide a rigid support for said table.

16. The sewing machine storage cabinet of claim 13 further comprising means to prevent further compression of said compressible and extendable member when said table is in its horizontal operative position so as to provide a rigid support for said table.

17. The sewing machine storage cabinet of claim 14 further comprising means to prevent further compression of said compressible and extendable member when said table is in its horizontal operative position so as to provide a rigid support for said table.

* * * * *